US006609998B2

(12) United States Patent
Lauzon et al.

(10) Patent No.: US 6,609,998 B2
(45) Date of Patent: Aug. 26, 2003

(54) METHOD AND APPARATUS FOR FABRICATING DOUBLE-ENDED CLOSURE BAGS AND DOUBLE COMPARTMENT BAGS

(75) Inventors: Robert Lauzon, Montreal (CA); Ritchie Baird, Laval-sur-le-Lac (CA); Guy J. Houle, Ste-Adele (CA); Pierre Papineau, Cornwall (CA); Richard Beauchesne, Terrebonne (CA)

(73) Assignee: Glopak Inc., Montreal (CA)

( * ) Notice: Subject to any disclaimer, the term of this patent is extended or adjusted under 35 U.S.C. 154(b) by 0 days.

(21) Appl. No.: 10/229,604

(22) Filed: Aug. 27, 2002

(65) Prior Publication Data

US 2003/0004046 A1 Jan. 2, 2003

Related U.S. Application Data

(62) Division of application No. 09/723,167, filed on Nov. 27, 2000, now Pat. No. 6,440,051.

(51) Int. Cl.[7] ..... B31B 39/04

(52) U.S. Cl. ..... 493/194; 53/133.3; 53/133.6; 53/133.8; 53/562; 493/212; 493/213; 493/214; 493/227; 383/41; 383/71; 383/204; 383/209

(58) Field of Search ..... 53/133.4, 133.6, 53/133.8, 139.2, 546, 550, 562, 412, 417; 493/212–214, 927, 189, 194, 256, 223, 410, 443, 227, 439; 383/41, 71, 61, 62, 120, 204, 209; 206/554

(56) References Cited

U.S. PATENT DOCUMENTS

| | | | | |
|---|---|---|---|---|
| 3,779,139 | A | 12/1973 | White | 383/62 |
| 5,147,278 | A | 9/1992 | Demura et al. | 493/439 |
| 5,682,730 | A | 11/1997 | Dobreski | 53/469 |
| 5,938,337 | A | 8/1999 | Provan et al. | 383/120 |
| 6,440,051 | B1 * | 8/2002 | Lauzon et al. | 493/194 |

* cited by examiner

*Primary Examiner*—Rinaldi I. Rada
*Assistant Examiner*—Thanh K. Truong
(74) *Attorney, Agent, or Firm*—Carter Schnedler & Monteith, P.A.

(57) ABSTRACT

A method and a machine for making a plastic film bag with opposed closable end openings as well as a double compartment bag is described. The bags may be formed from J-folded, U-folded or tubular film sheets. In one embodiment, a bag is formed with a gusseted end adjacent which a zipper closure and a detachable end is provided and at the other end of the bag there is provided an opening which is closable by a closure tag. The method and machine are also adaptable to form double-ended closure bags having two distinct compartments, each accessible by a respective one of the end closure. The bags formed by the method and machine have various uses such as carrying two separate articles, each article being accessible from one of the opposed ends of the bags. The double compartment bags may also contain two different products, each accessible separately through a zipper closure. The bags may also be formed with a flap provided with wicket holes to support the bag in an automatic bag filling machine.

6 Claims, 9 Drawing Sheets

METHOD AND APPARATUS FOR FABRICATING DOUBLE-ENDED CLOSURE BAGS AND DOUBLE COMPARTMENT BAGS

CROSS-REFERENCE TO RELATED APPLICATION

This application is a divisional of application Ser. No. 09/723,167, filed Nov. 27, 2000 now U.S. Pat. No. 6,440,051.

TECHNICAL FIELD

The present invention relates to a method and an apparatus for fabricating double-ended closure bags and double compartment bags.

BACKGROUND ART

Zipper lock bags have been used for many years for various purposes, particularly for storing condiments and all sorts of food products. Such bags continue to enjoy increased use and popularity. They are very sanitary, take very little space when stored, are easy to carry and are substantially expensive to produce. Such bags also come in different sizes, depending on their intended use.

SUMMARY OF INVENTION

It is a feature of the present invention to provide a method and an apparatus for fabricating plastic bags having opposed closable end openings to provide access to products placed in the bag from opposed ends of the bag and more particularly, but not exclusively, to different articles positioned in the bag and disposed adjacent each of the opposed ends.

Another feature of the present invention is to provide a plastic film bag with opposed closable end openings and wherein a gusset wall is formed adjacent one of the openings containing a zipper and wherein the other opening is closable by a closure tag.

Another feature of the present invention is to provide a method and apparatus for fabricating plastic film bags having two discrete inner compartments and opposed closable end openings whereby articles placed in the two compartments are accessible through a respective one of the opposed closable end openings.

Another feature of the present invention is to provide a method and apparatus for fabricating plastic film bags from a single film sheet and wherein the bag has two discrete inner compartments for carrying different items therein and wherein one of the compartments is provided with a support flap extending adjacent a zipper closure end.

According to the above features, from a broad aspect of the present invention provides a method of making a plastic film bag with opposed closable end openings. The method comprises the steps of drawing a prefolded film sheet through a gusset-forming station. The prefolded film sheet has opposed film panels, an open edge and an opposed closed parallel edge. The closed parallel edge is folded in a gusset former to form an offset gusset end. The gusset former has a lower and an upper film positioner provided with guide edges. An intermediate film positioner is disposed between the lower and upper film positioner. One of the guide edges is offset in a vertical plane from the other guide edge whereby to form a double offset folded closed edge to define an outer folded edge and an inwardly spaced folded edge interconnected through an intermediate inwardly spaced folded film section. The method also comprises serrating a tearline adjacent the outer folded edge. The outer folded edge is drawn through a zipper applicator to heat-fuse a plastic zipper section on the panels along the outer folded edge inwardly of the tearline towards the inwardly-spaced folded edge. The prefolded film sheet is then fed with its offset gusset and with the zipper sections and tearline, through a bag former where the prefolded film sheet is transversely slit and edge sealed to form plastic bags with a closable open end and an opposed gusseted zippered open end.

According to a still further broad aspect of the present invention there is provided a method of making plastic bags with two inner compartments and wherein each bag has opposed closable end openings for independent access to the compartments. The method comprises the steps of drawing a prefolded film sheet having opposed film panels and opposed longitudinal parallel outer edges through a line sealer to form a division seal to segment the prefolded film sheet in two sections. The prefolded film sheet is drawn through a zipper applicator station to heat fuse a plastic zipper sections on the panels adjacent opposed longitudinal parallel outer edges and parallel to the division seal. The prefolded film sheet with the division seal and opposed plastic zipper sections is then fed through a bag former where the prefolded film sheet is slit and edge sealed to form the plastic bags having two compartments each accessible by a respective one of the plastic zippers.

According to a still further broad aspect of the present invention there is provided a machine for fabricating plastic film bags with opposed closable end openings and with a gusseted wall formed adjacent one of the closable openings. The machine comprises drive means to draw a prefolded film sheet having opposed film panels, an open edge and closed parallel edge through a gusset former. The gusset former receives a portion of the closed parallel edge therethrough and has a lower and an upper film positioner plate each provided with a guide edge to define a first and a second guide edge, and an intermediate film guide means having an intermediate guided edge inwardly spaced, the first and second guide edges. The first and second guide edges are spaced offset from one another whereby to form a double offset folded closed edge defining an outer folded edge and an inwardly spaced folded edge interconnected through an intermediate inwardly spaced folded film section. A serrating wheel is pressed against the outer folded edge to form a serrated tear line through opposed film panels adjacent the outer folded edge. A zipper applicator is provided to heat fuse a plastic zipper section on the panels along the outer folded edge inwardly of the tear line towards the inwardly spaced folded edge. A bag former effects a transverse slit and edge seals to form plastic bags having a closable open end and an opposed gusseted zippered end.

According to a still further broad aspect of the present invention there is provided a machine for fabricating plastic bags having two inner compartments and opposed closable end openings for independent access to the compartments. The machine comprises drive means to draw a prefolded film sheet having opposed film panels and opposed longitudinal parallel outer edges through a line sealer to form a division seal to segment the prefolded film sheet in two attached sections. A pair of zipper applicators are provided to heat fuse a zipper section on the panels adjacent opposed longitudinal parallel outer edges and parallel to the division seal. A bag former effects a transverse detachment line and edge seals to form plastic bags having two compartments each accessible by a respective one of the plastic zippers.

According to a further broad aspect of the present invention there is a provided a plastic film bag having opposed film panels, sealed side edges, closable end openings having a zipper closure and a transverse seal line defining two inner compartments. Each compartment is accessible through a respective one of the closable end openings.

BRIEF DESCRIPTION OF DRAWINGS

A preferred embodiment of the present invention will now be described with reference to the accompanying drawings in which.

DESCRIPTION OF PREFERRED EMBODIMENTS

Figure 2:
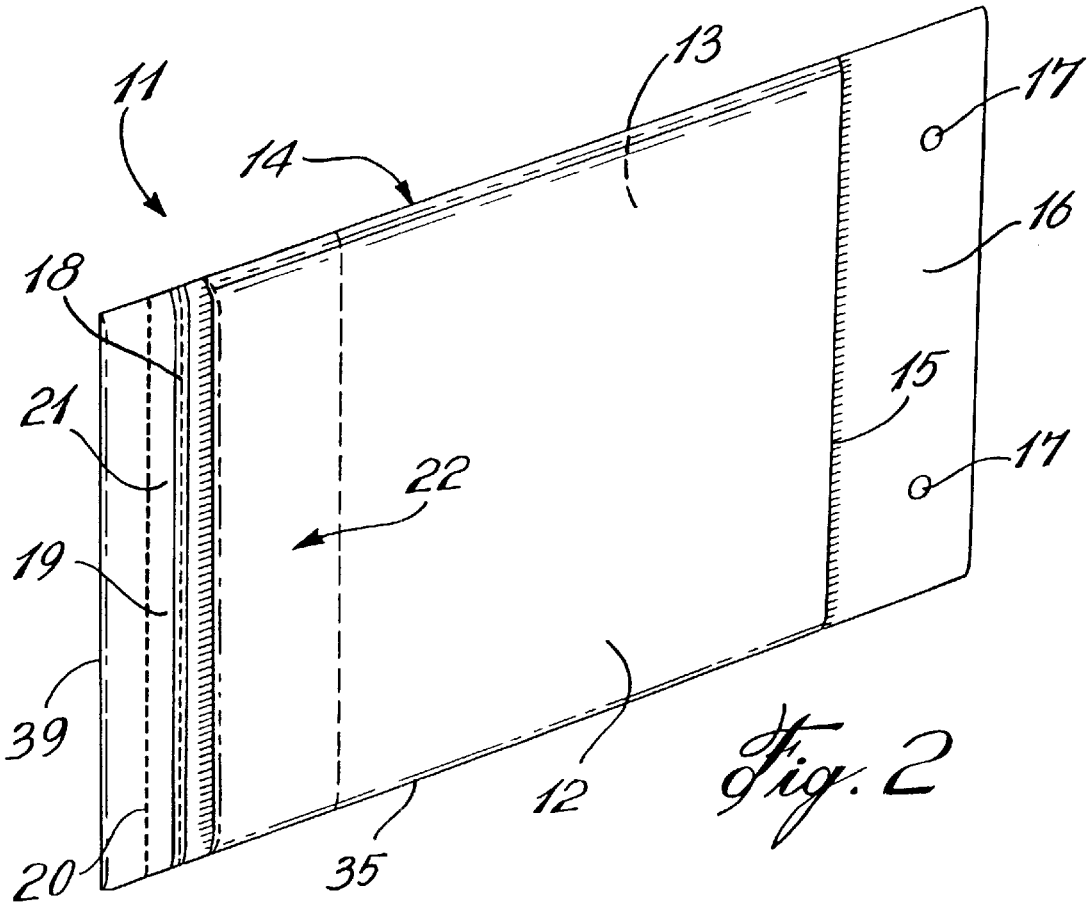
FIG. 2 is a perspective view of a plastic film bag formed in accordance with the present invention and having opposed closable end openings and with a gusseted wall being formed adjacent a closable zipper end opening.

Referring now to the drawings, there is shown generally at 10 a machine for making plastic bags having opposed closable openings of the type as illustrated in FIGS. 2, 9, 13*a*, 14*a* and 15*a* or variations thereof. Referring to the plastic bag 11, as shown in FIG. 2, it is comprised of a front panel 12, a rear panel 13, fused together along side seams 14 and 14'. The rear panel 13 extends beyond the mouth opening 15 to define a flap 16 which is herein provided with wicket holes 17 to hold the bag in an automatic filling machine, not shown. The other end of the bag is provided with a zipper closure 18 spaced inwardly from an outer folded edge portion 19 of the bag. A perforated tear line 20 extends through the panels and provides for this outer edge portion 19 to be torn off whereby to separate the panels at the end section 21 to cause the zipper closure 18 to unlock, as is well known in the art. An important feature of the plastic bag 11 as shown in FIG. 2 is that a gusset end wall 22 is formed adjacent the zipper closure, whereby to cause the bag to expand, as shown in FIG. 3, whereby to accommodate two products 23 and 23' in the bag.

Figure 3:
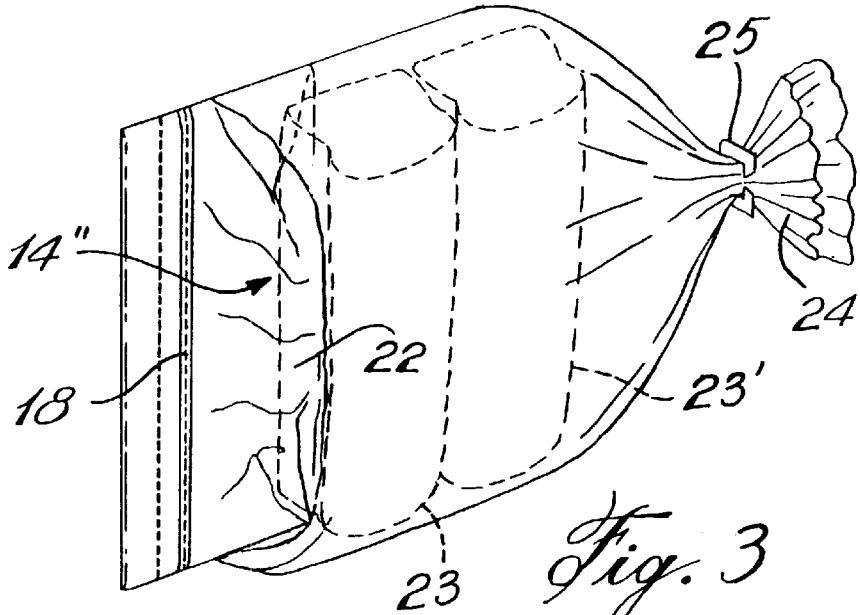
FIG. 3 is a perspective view showing the back of FIG. 1 and in which two products have been placed with each product being accessible from a respective one of the closable end openings.

As shown in FIG. 3, one product, namely 23, is disposed against the gusset end wall 22 and is accessible by opening the zipper closure 18. The other product 23' is accessible through the gathered open end 24 by removing the closure tag 25. In this particular illustration, the products 23 and 23' are bread loaves with one being a white bread and the other being a brown bread. Of course, other different products may be provided in such bag.

Figure 4:
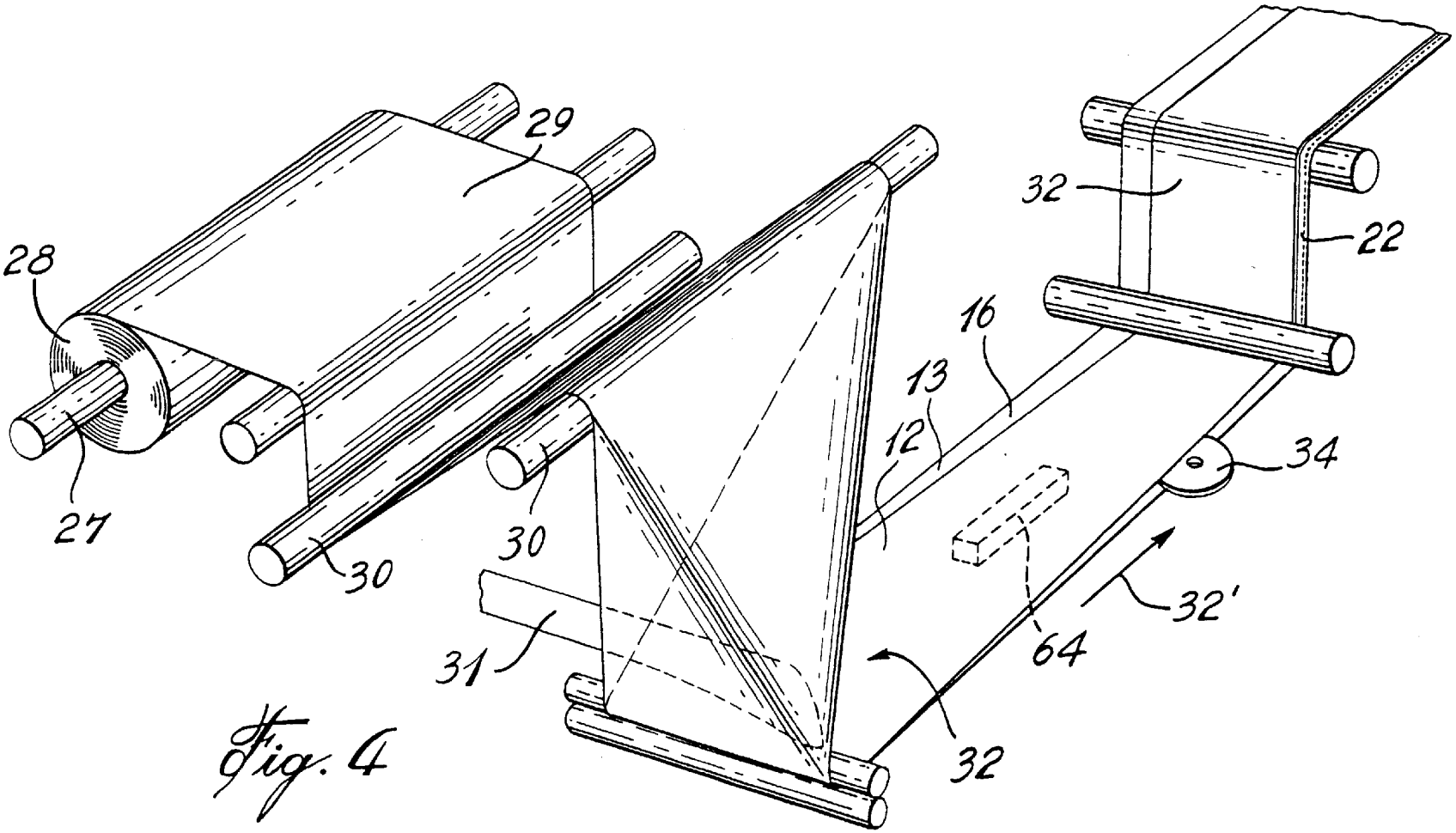
FIG. 4 is a perspective view of the apparatus of FIG. 1 showing a film sheet being folded in a J-fold and drawn through a gusset former constructed in accordance with the present invention.
Figure 5:
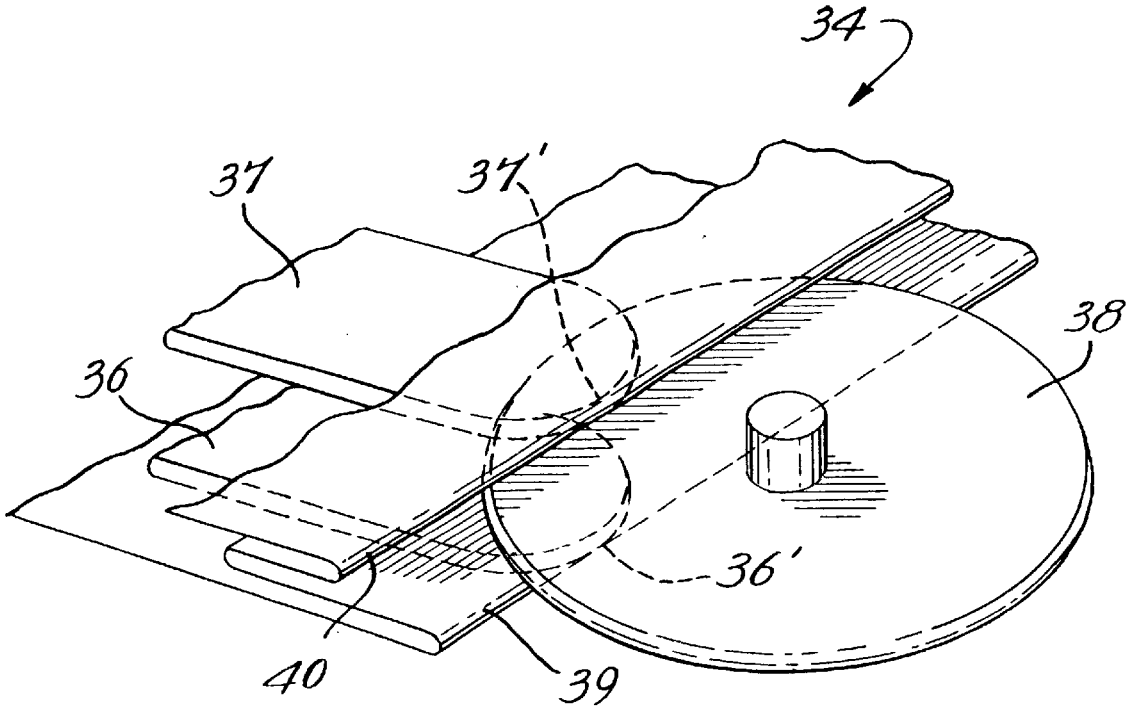
FIG. 5 is a fragmented perspective view showing the construction of the gusset former.
Figure 6:
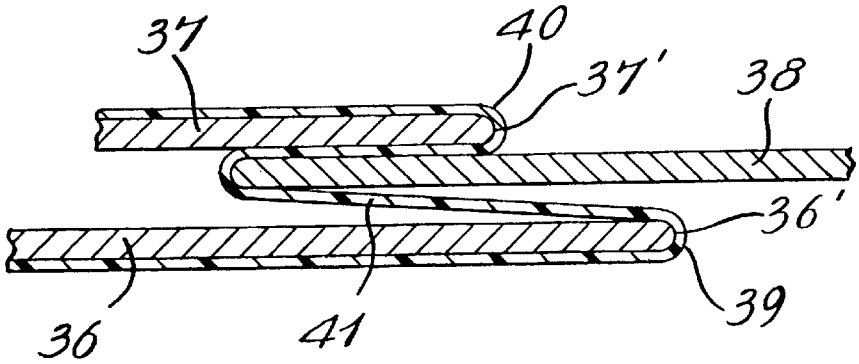
FIG. 6 is a fragmented section view showing the inter-relationship of the inner and outer film positioners and the intermediate positioner with the film sheet folded end drawn thereagainst.
Figure 12:
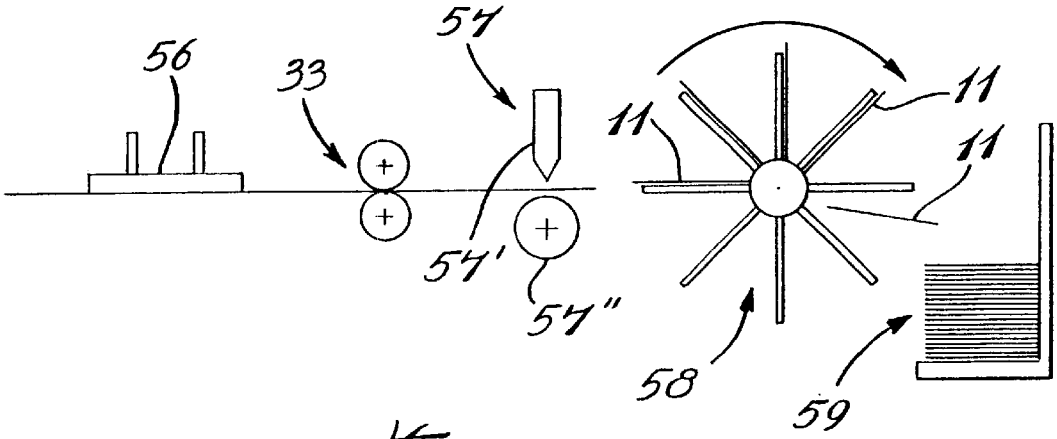
FIG. 12 is a further schematic view of the end section of the machine including the sealing and cutting bar where the bags are formed and discharged.

With reference now to FIGS. 4 to 6, there will be described a manner in which the gusset end wall 22 is formed. The simplified illustration of FIG. 4 constitutes the rear end section 26 of the machine and as hereinshown, there is provided a mandrel 27 on which a film supply roll 28 (see FIG. 4) is secured. The film sheet 29 is folded about guide rolls 30 and drawn over a sheet folder 31 as is well known in the art, whereby to form a J-folded sheet 32 wherein the flap 16 is formed. The film is drawn in the direction of arrow 32' by drive rolls 33 as shown in FIG. 12 and located at the front end of the machine 10.

Figure 7:
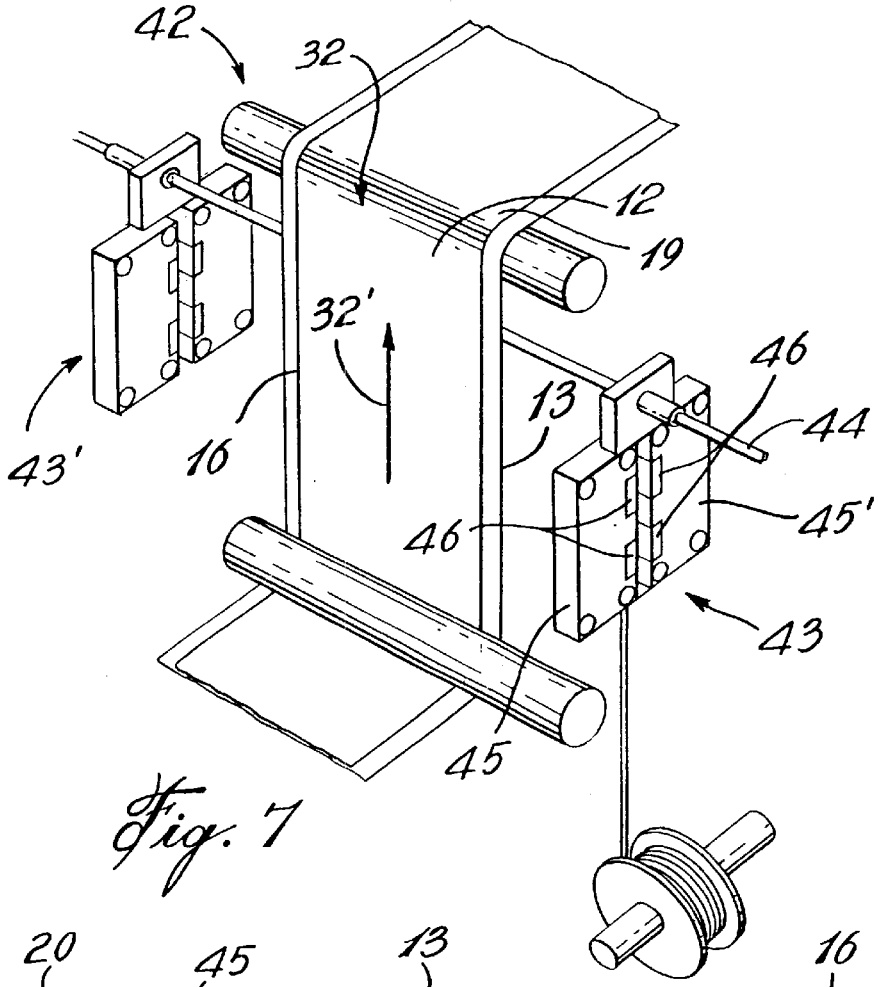
FIG. 7 is a perspective view of another section of the machine of FIG. 1 herein illustrating the zipper applicator section of the machine.

In order to form the gusset end wall 22, there is provided a gusset former assembly 34 which folds the folded edge 35 of the J-folded sheet 32 and which assembly is more clearly illustrated by FIGS. 5 and 6. As hereinshown, the gusset former assembly is constituted by a lower and an upper film positioning plate 36 and 37 and each provided with guide edge 36' and 37', respectively. An intermediate film guide wheel 38 is disposed between the space parallel positioner plates 36 and 37. The disposition of the stationary plates 36 and 37 and the guide wheel 38 is illustrated more clearly in FIG. 6 and as hereinshown these plates are disposed parallel to one another. Of course, these plates are also adjustable to provide for gussets of varying sizes as is dictated by the bag design. As hereinshown the guide edges 36' and 37' are offset from one another whereby to form a bag with a double offset folded closed edge defining an outer film folded edge 39 and an inwardly spaced folded edge 40 interconnected together through an intermediate inwardly spaced folded film section 41. After the bag is thus folded it is drawn through a zipper application station 42, of a type well known in the art, and as illustrated more clearly in FIG. 7 and whereat the folded film sheet 32 is continuously drawn in the direction of arrow 32'.

The zipper applicating station is hereinshown as comprising a plastic zipper applicator 43 which is displaceable on a guide rod 44 whereby to position the zipper closure female section or part 45 and male part 45' against the rear panel 13 and front panel 12 and fuse them thereon by the heating bars 46 provided in the zipper applicator 43. This zipper applicator is well known in the art. An additional zipper applicator 43' may be provided on the other side of the folded film sheet when it is necessary to affix opposed zipper locks on the folded film sheet as will be described later when describing the construction of a double compartment bag with opposed closable openings.

Figure 8:
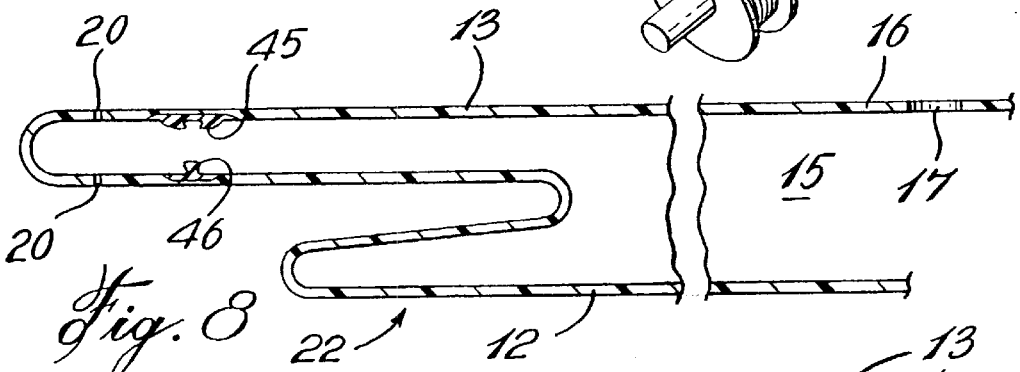
FIG. 8 is a fragmented longitudinal section view of the plastic film bag as illustrated in FIG. 1 and as taken substantially through the longitudinal central axis of the bag.

FIG. 8 illustrates the position of the female and male zipper closures 45 and 46 on the back and front panels 12, as well as the gussetted folded end wall 22. As hereinshown there is also formed the perforated tear line 20 through both the front and rear panels. These panels are hereinshown separated but in fact they are juxtaposed and heat fused along their opposed side edges to form the side seams 14 as will be described later.

Figure 9:
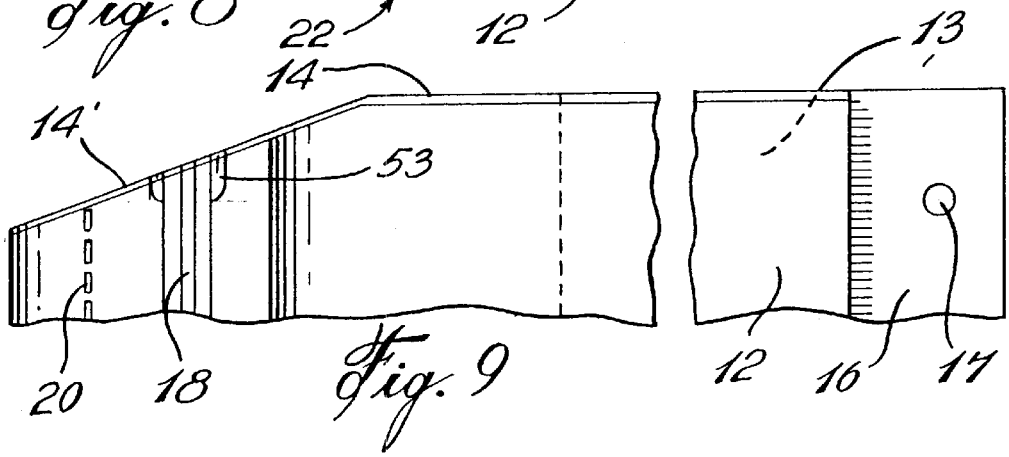
FIG. 9 is a top fragmented side view of the film bag and gussetted end having an angulated end edge to form a square gussetted end wall.
Figure 10:
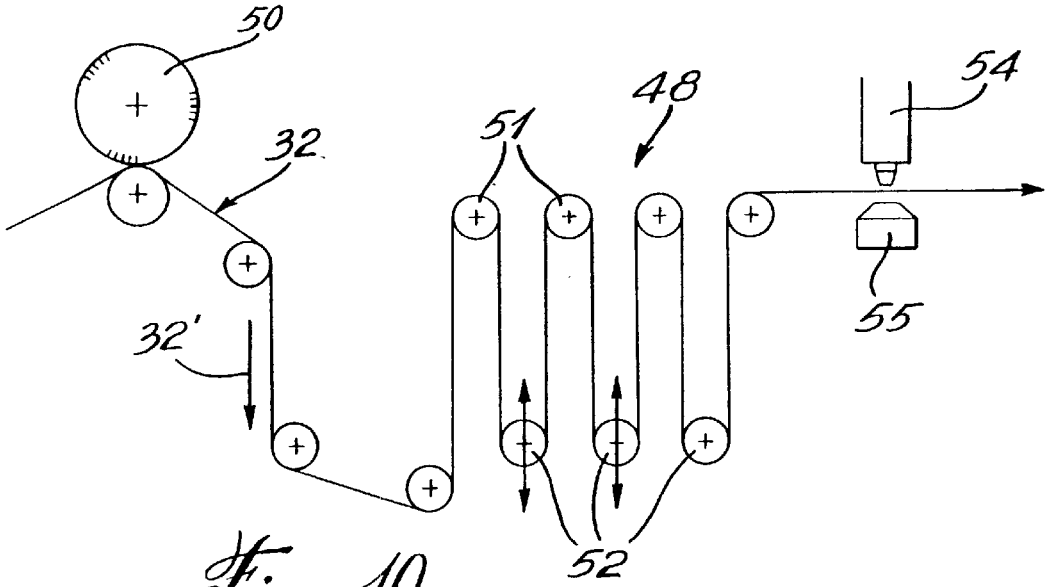
FIG. 10 is a schematic view showing a further part of the machine showing a serrating wheel applied against the film folded end edge to effect a tear line along the folded film sheet; a dancer roll section to provide a continuous drive to the forward section of the machine prior to the bag folding section; and further showing a forming head to compress end regions of the plastic zipper prior to the slitting step.

FIG. 9 shows a modified gussetted end of the bag where the side seam 14 is angulated at 14' whereby to form a gusset end wall 14", see FIG. 3, which is substantially square. This angulated seam would be formed in the square bottom sealer section 49 of the machine.

When the J-folded sheet 32 exits the zipper applicator it is then drawn through a dancer roll assembly 48 at the front end of the square bottom sealer section 49 of the machine, as schematically illustrated by FIG. 12. A serrating cutting wheel 50 is pressed against the outer edge portion 19 of the folded film 32 to form the perforated tear line 20 in opposed film sheets. The folded film sheet then goes through a plurality of stationary rolls 51, then dancer rolls 52 whereby to impart a substantially constant drive to the folded film sheet 32 in the rear end section of the machine prior to the folded film sheet reaching the sealing section where the folded film sheet is intermittently driven to permit slitting and sealing operations.

Figure 11:
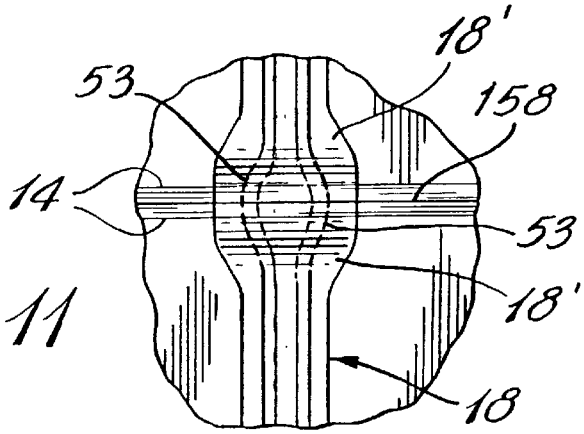
FIG. 11 is an enlarged fragmented side view showing the thin compressed region of the plastic zipper.

Because the zipper is a fairly thick plastic part, as compared to the film sheet, it is desirable to compress the outer edges 18' of the zipper as clearly illustrated in FIG. 11 whereby to form a thin plastic section in areas where the side seam 14 is to be formed. This is done by squeezing the end section 53 of the zipper, or another section depending on the shape of the gusset end wall to be formed, between a forming head 54 and an anvil 55 when the film is stopped with the zipper aligned with the forming head.

The folded film sheet is then drawn, as shown in FIG. 12, wherein the folded film sheet is drawn through a hole punch 56 which punches the wicket holes 17 in the flap 16. It is pointed out that the forming head 54, the hole punch 56 and the sealing and cutting bar 57 assembly including a hot knife 57' and sealing roll 57" are all synchronized together and with the drive rolls 33. As hereinshown, the folded film sheet is then fed through a sealing and slitting bar to form the side seals 14 and to slit the folded sheet into bags along cut line 58 as shown in FIG. 11. The then-formed plastic bags 11 are then discharged by the drive rolls 33 onto a transporting turret 58 wherein the bags are discharged into a stack 59 or a container or conveyed to another station for processing.

Summarizing the method of forming the bag as illustrated in FIG. 2, it consists essentially of drawing a prefolded film sheet through a gusset former to form an offset gusset end wall, then a serrated tear line is formed adjacent an outer folded edge of the folded film sheet, and the folded edge is drawn through a zipper applicator station where a zipper section is fused on the opposed panels of the folded sheet. The prefolded film sheet with the offset gusset and the zipper and tear line is then fed through a bag former where the bags are transversely slit and edge sealed. To effect the edge sealing and transverse cutting it is desirable to compress a region of the plastic zipper, as shown in FIG. 11, whereby to reduce the thickness of the zipper to facilitate slitting and sealing.

Figure 1:
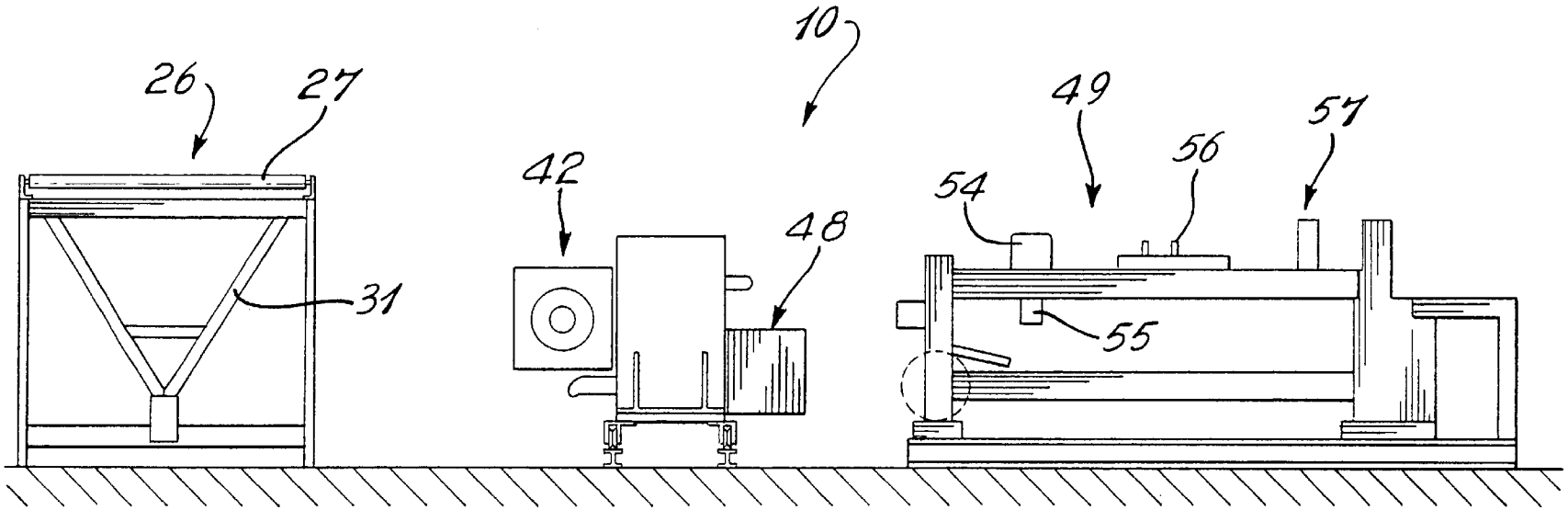
FIG. 1 is a block diagram showing a machine for making a plastic film bag with opposed closable end openings.

With reference now to FIGS. 13*a* through 15*b*, there is shown the construction of a plastic film bag 60 which is formed with the machine as shown in FIG. 1 but modified slightly whereby the plastic film bag 60 is formed with two inner compartments 61 and 62 which are separated by a transverse seal line 63. The entire bag is formed from a single film sheet which is not cut into panels. This seal line 63 may be formed by positioning a sealer unit 64 centrally of the film folded panels and it is preferable when forming such bag 60 to use a U-fold film sheet 65 as shown in FIG. 13*b*. As hereinshown, the U-fold sheet has a opposed panels 66 and 66' which are of substantially equal width. The gusset former assembly 34 is not utilized in this process but it is necessary to draw the U-folded film sheet through the serrating wheel 50 whereby to form the perforated tear line 67 adjacent the folded edge 68 of the U-folded film sheet. Also, two zipper applicators 43 and 43' are utilized to affix two zippers 69 and 69' adjacent opposed ends of the prefolded sheet. The opposed end 70 of the sheet is an open end and accordingly, it is not necessary to perforate the film sheets at that end to tear off the folded end portion 68.

Figure 13A:
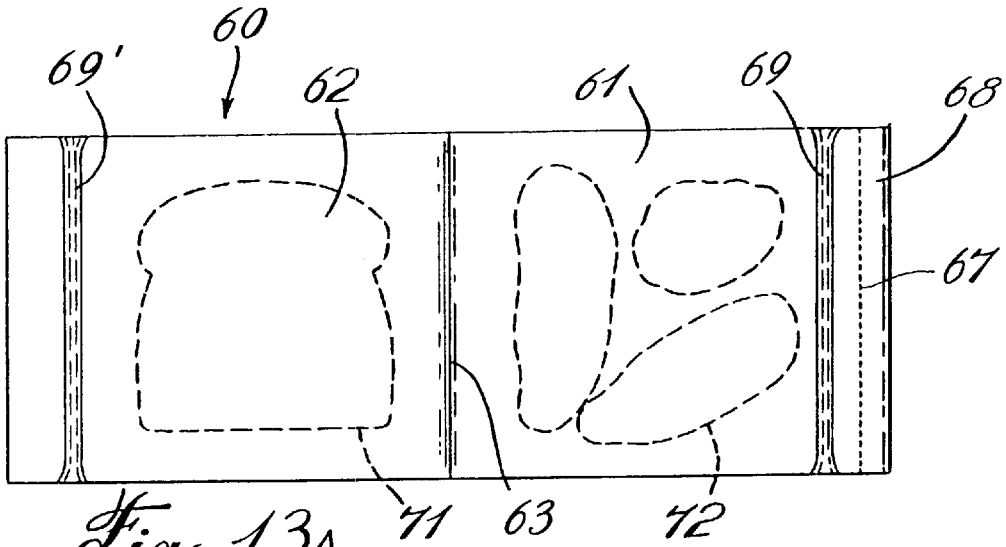
FIG. 13*a* is a plan view of a plastic film bag formed from a single film sheet and having two distinct inner compartments and opposed closable end openings.
Figure 13B:
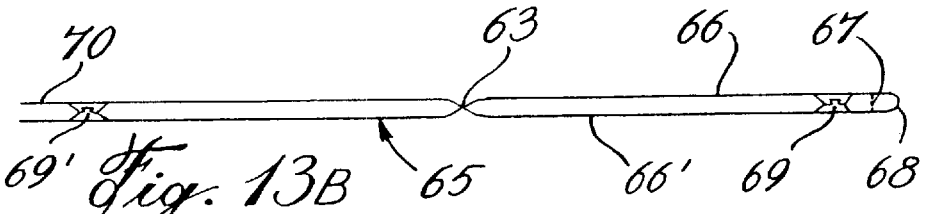
FIG. 13*b* is a section view showing the U-film prefold film sheet.

The plastic film bag 60 as shown in FIG. 13*a* provides for two separate compartments being accessible to a respective closable open end. Such film bags find many uses such as for packing lunch bags where a sandwich 71 can be packaged in one of the compartments herein compartment 62 and the other compartment provided with condiments 72 such as tomatoes, pickles, chocolate bars, etc., which are different type condiments which should not be contact with bread but wherein both can remain fresh and isolated from one another. Such bag also provides for quick and easy packing as it is not necessary to provide separate type packaging for the foodstuff or the provision of plastic containers which are usually never the proper size and take unnecessary space when packaged. Such double compartment plastic bag also provides visual access to its different type contents.

Figure 14B:
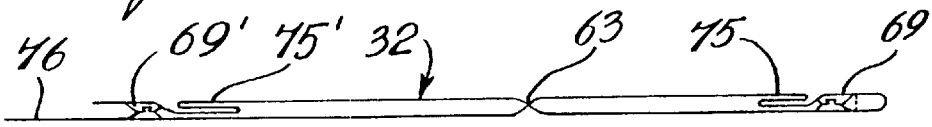
FIG. 14*b* is a section view of the prefold J-film to construct a bag of FIG. 14*a;*
Figure 14A:
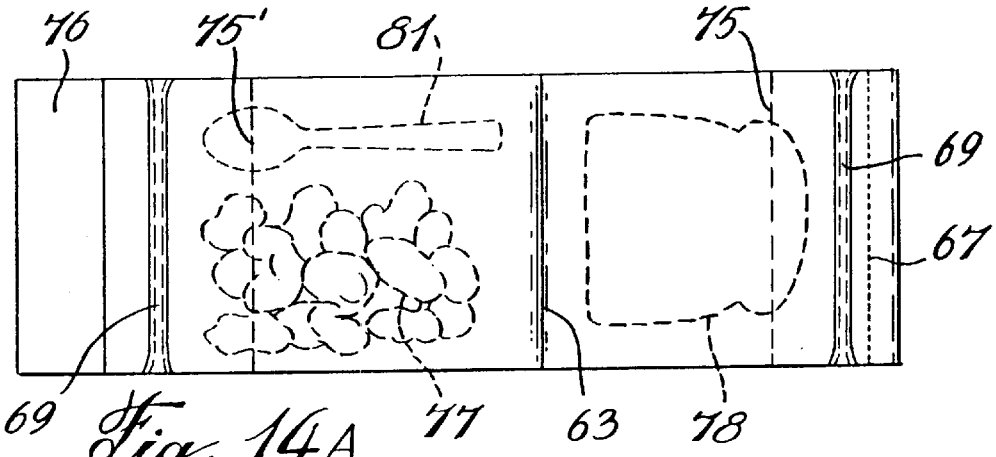
FIG. 14*a* is a plan view of another bag similar to FIG. 13*a* having two inner compartments with gussets associated with each compartment.
Figure 17:
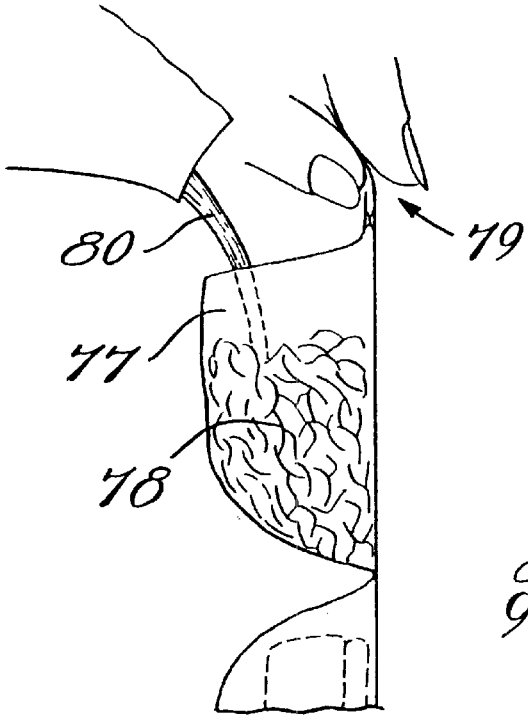
FIG. 17 is a fragmented side view showing a use of the plastic bag with two inner compartments.

FIGS. 14*a* and 14*b* show a bag similar to that as described with reference to FIG. 13*a* but one that is formed with a J-folded film whereby to provide a flap 76 adjacent one end of the double compartment bag. As also hereinshown, one compartment, herein compartment 77, may be larger than compartment 78 depending on its intended use. A typical use of such bag is illustrated in FIG. 17 wherein in compartment 77 there may be disposed a cereal 78 and wherein the flap 76 provides finger support, such as illustrated by reference to numeral 79, to permit the compartment 77 to be held in the fashion herein illustrated to insert a liquid 80 within the bag and to eat the cereal. A plastic spoon 81 may also be provided in the compartment together with the cereal 77. The other compartment may include a sandwich or other condiment. Gusseted sections 75 and 75' are formed adjacent opposed zippers 69 and 69' t permit the compartments to expand when a product is inserted in the compartments.

Of course, only one gusset fold may be provided, and these are formed as described above.

Figure 15A:
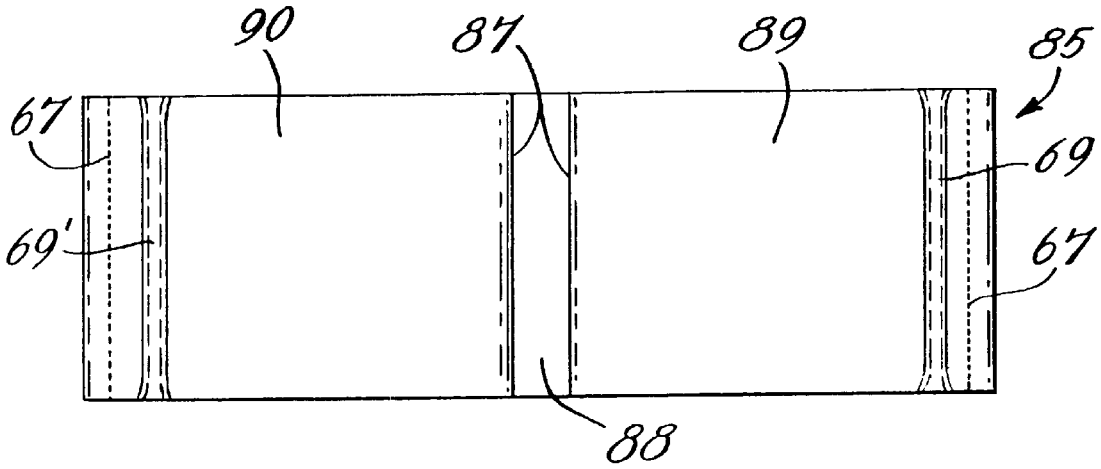
FIG. 15*a* is a still further plan view of a plastic film bag having two inner compartments and provided with two transverse seal lines to form a central panel.
Figure 15B:
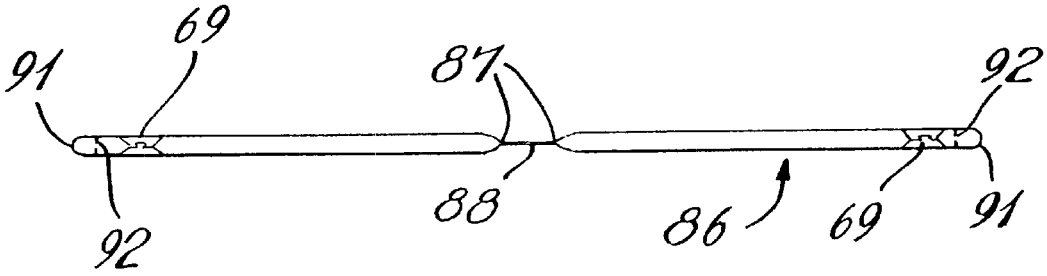
FIG. 15*b* is a section view of a tubular film utilized to form the bag of illustrated FIG. 15*a;*

FIGS. 15*a* and 15*b* show a still further embodiment and wherein the plastic film bag 85 is herein formed by the use of a tubular film 86 as illustrated in FIG. 15*b*. As also illustrated, the bag is herein formed with two spaced-apart transverse seal lines 87 to define a narrow panel region 88 between the two inner compartments 89 and 90. Because opposed ends of the folded film sheet are closed ends 91, it is necessary to form perforated tear lines 92 adjacent both these ends to permit access to the zipper closures 69.

Figure 16A:
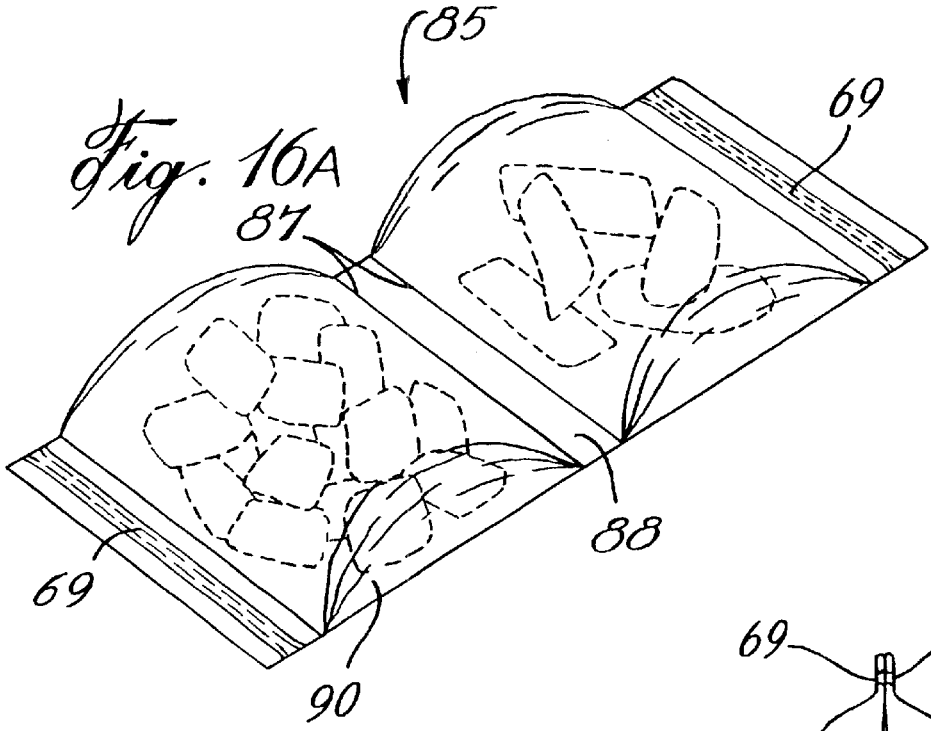
FIG. 16*a* is a perspective view of a double compartment bag with the inner compartments spaced from one another by a narrow panel section.
Figure 16B:
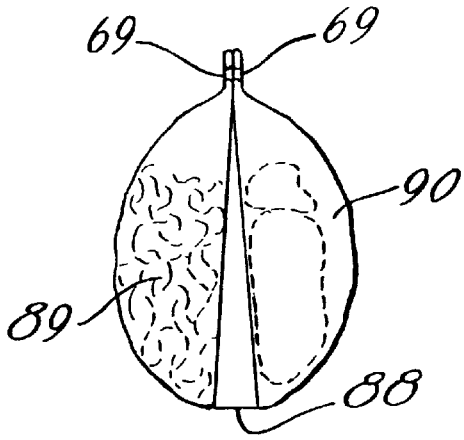
FIG. 16*b* is a simplified side view showing the bag of FIG. 16*a* folded in half to provide a compact package.

FIGS. 16*a* and 16*b* illustrate the utility of the narrow panel 88 and as hereinshown, it facilitates folding the two compartment sections together, as illustrated more clearly in FIG. 16*b* to form a more compact package to insert within a lunchbox or an outer carton enclosure, etc.

Although not described herein, it is conceivable that a two-compartment bag be formed with opposed flaps having wicket pin holes and this can be achieved by overlying two plastic film sheets one exceeding opposed ends of the other to provide the flaps. Zippers can then be applied adjacent the edges of the narrower panel adjacent the flaps. Adjacent the zipper of the narrow panel would be provided a flap section which can be engageable by bag opening and filling machines whereby to fill these bags with a food product and then re-seal the zipper. The bag is then manipulated so that the other compartment is filled by similar mechanism. Gussetted end walls could also be formed. However, the intent of the double compartment bag is more for domestic use in packaging different type foodstuff in a single bag and isolated from one another.

It is within the ambit of the present invention to cover any obvious modifications of the preferred embodiment described herein, provided such modifications fall within the scope of the appended claims.

We claim:

1. A method of making a plastic film bag with opposed closable end openings, said method comprising the steps of:

i) drawing a prefolded film sheet through a gusset forming station, said prefolded film sheet having opposed film panels, an open edge and an opposed closed parallel edge, ii) folding said closed parallel edge through a gusset former to form an offset gusset end, said gusset former having a lower and an upper film positioner provided with guide edges, an intermediate film positioner between said lower and upper film positioner, one of said guide edges being offset in a vertical plane from the other guide edge whereby to form a double offset folded closed edge to define an outer folded edge and an inwardly spaced folded edge interconnected through an intermediate inwardly spaced folded film section, iii) serrating a tear line adjacent said outer folded edge, iv) drawing said outer folded edge through a zipper applicator to heat fuse a plastic zipper section on said panels along said outer folded edge inwardly of said tear line towards said inwardly spaced folded edge, and v) feeding said prefolded film sheet with said offset gusset end and with said zipper and tear line through a bag former where said prefolded film sheet is transversely slit and edge sealed to form plastic bags with a closable open end and an opposed gusseted zippered end.

2. A method as claimed in claim 1 wherein said prefolded film sheet is a J-folded film sheet and wherein one of said panels at said open edge is longer than the other panel to form a wicket attaching flap, there being provided the further step of punching wicket holes in said flap.

3. A method as claimed in claim 1 wherein after step (iv) there is provided the further step of heat compressing predetermined spaced-apart regions of said plastic zipper to form thin plastic regions, said step (v) including cutting and edge sealing said prefolded film through said thin plastic regions.

4. A method as claimed in claim 1 wherein said step (v) comprises drawing said prefolded film sheet intermittently through said bag former while continuing to draw said prefolded film sheet at a substantially constant speed through said steps (i) to (iv).

5. A method as claimed in claim 1 wherein said prefolded film sheet is a U-folded film sheet and wherein said step (iv) also comprises drawing said open edge through another zipper applicator to heat fuse a second plastic zipper spaced a predetermined distance from said open edge.

6. A method as claimed in claim 1 wherein prior to step (i) there is provided the further steps of (a) drawing a film sheet from a film roll, and (b) passing said sheet about a sheet folder to form said pre-folded film sheet.

* * * * *